United States Patent [19]

Yamaji et al.

[11] Patent Number: 4,923,547

[45] Date of Patent: May 8, 1990

[54] PROCESS FOR PRODUCING COMPOSITE MOLDED ARTICLES FROM NONWOVEN MAT

[75] Inventors: Katsuhiko Yamaji, Kyoto; Masahiko Ishida, Yokohama; Masahiro Tsukamoto, Takatsuki, all of Japan

[73] Assignee: Sekisui Kagaku Kogyo Kabushiki Kaisha, Osaka, Japan

[21] Appl. No.: 233,282

[22] Filed: Aug. 17, 1988

[30] Foreign Application Priority Data

| | | | |
|---|---|---|---|
| Aug. 20, 1987 | [JP] | Japan | 62-207674 |
| Aug. 20, 1987 | [JP] | Japan | 62-207675 |
| Sep. 16, 1987 | [JP] | Japan | 62-231742 |
| Sep. 16, 1987 | [JP] | Japan | 62-231743 |
| Dec. 15, 1987 | [JP] | Japan | 62-316728 |
| Dec. 22, 1987 | [JP] | Japan | 62-326461 |
| May 12, 1988 | [JP] | Japan | 63-115398 |

[51] Int. Cl.[5] ..... B32B 5/00; B32B 5/16; B32B 5/24

[52] U.S. Cl. ..... 156/181; 156/62.2; 156/62.6; 156/242; 156/296; 264/257; 264/258; 264/320; 264/322

[58] Field of Search ..... 156/180, 181, 62.6, 156/62.2, 296, 242; 181/284, 294; 264/322, 113, 122, 257, 258, 294, 320

[56] References Cited

U.S. PATENT DOCUMENTS

| | | | |
|---|---|---|---|
| 2,325,594 | 8/1943 | Denman | 181/294 X |
| 3,621,092 | 11/1971 | Hofer | 264/120 X |
| 3,664,909 | 5/1972 | Ackley | 156/181 X |
| 3,684,645 | 8/1972 | Temple et al. | 156/166 X |
| 3,850,723 | 11/1974 | Ackley | 156/180 |
| 3,865,661 | 2/1975 | Hata et al. | 156/180 X |
| 4,044,188 | 8/1977 | Segal | 156/62.2 X |
| 4,151,023 | 4/1979 | Platt et al. | 156/181 X |
| 4,320,167 | 3/1982 | Wishman | 156/62.6 X |

*Primary Examiner*—Michael W. Ball
*Assistant Examiner*—Jeff H. Aftergut
*Attorney, Agent, or Firm*—Wenderoth, Lind & Ponack

[57] ABSTRACT

A composite molded article made of a nonwoven fibrous mat wherein inorganic monofilaments having a length of 10 to 200 mm and a daimeter of 2 to 30 micrometers are partially bonded with a thermoplastic resin binder, many voids being provided throughout the mat and a large number of fine holes communicating with the voids in the inside being formed in at least one surface of the mat; and processes for producing the same.

31 Claims, No Drawings

PROCESS FOR PRODUCING COMPOSITE MOLDED ARTICLES FROM NONWOVEN MAT

This invention relates to a lightweight composite molded article excellent in rigidity, heat resistance, acoustical properties and moldability, and specifically to a composite molded article suitable as an automobile ceiling material, and a process for producing same.

Corrugated papers and glass fiber reinforced thermosetting resin sheets have been hitherto used as a substrate of a ceiling material being one of automobile interior materials. However, corrugated papers are poor in heat moldability and lack acoustical properties. Besides, as they are hygroscopic, they absorb moisture and become heavy, causing sagging. The thermosetting resin sheets are poor in productivity and heat moldability and also heavy.

Various proposals have been made to eliminate these defects. For example, Japanese Laid-open Utility Model Application No. 15035/1983 describes an automobile interior material formed by sequentially laminating a soft synthetic resin foam and a vinyl chloride leather on one side of a laminate wherein glass fiber reinforced thermoplastic resin films are laminated on both sides of a styrene resin foamed sheet. The above interior material has excellent heat resistance and mechanical strengths, but is relatively heavy, lacks acoustical properties, and is pricey and still poor in heat moldability.

Japanese Laid-open Patent Application No. 83832/1985 involves an automobile ceiling material formed by laminating a foam layer and a skin on a surface of a substrate wherein thermoplastic resin layers are laminated on both sides of a glass fiber layer. The above substrate is thin, and has high mechanical strengths and excellent heat moldability, but lacks acoustical properties and heat insulation properties. A foam layer has to be laminated as an automobile ceiling material, and heat moldability is poor as a whole.

Besides, in order to improve acoustical properties, an acoustical material is laminated or penetration holes are formed in a substrate (Japanese Laid-open Patent Application Nos. 11947/1980 and 14074/1978 and Japanese Patent Application No. 60944/19982). However, producing steps become complex, costs become high and tobacco fumes enter the penetration holes to make dirty the surface.

There has been known a material wherein a synthetic resin foam such as a polyurethane foam and a decorative skin material such as a fabric are bonded in this order by an adhesive or by heat on one side of a nonwoven fabric impregnated with a thermosetting resin such as a phenolic resin (e.g. Japanese Patent Publication No. 11837/1979 and Japanese Laid-open Patent Application No. 56283/1973). In this type of the automobile ceiling material, the nonwoven fabric impregnated with the thermosetting resin such as a phenolic resin requires much time to cure the resin, harmful substances occur, a void ratio is low, acoustical properties are not enough, and the weight is relatively heavy.

A glass fiber reinforced resin sheet for obtaining a molded article by heating and pressing is described as a stampable sheet in Japanese Patent Publication Nos. 34292/1983 and 13714/1973 (U.S. Pat. No. 3,850,723 and British Patent No. 1,306,145) and Japanese Laid-open Patent Application No. 161529/ 1987 (European Patent Application No. 0 223 450). It is stated that the stampable sheet is a glass fiber reinforced thermoplastic resin sheet, and when the sheet is heated in stamping, the thickness of the stamping sheet is increased by resiliency of the glass fibers in the resin. However, the stamped article is dense and has high specific gravity and strength and is used as a lawn mower's cover, a panel of a tractor, an instrument case, an outer frame of a traveler's bag, an automobile sunroof or a light receiver of an automobile tail portion, vastly different from the lightweight composite molded article of this invention excellent in rigidity, heat resistance and acoustical properties and having a high void ratio.

Japanese Patent Publication No. 34292/1983 includes a process for producing a glass fiber reinforced thermoplastic resin molded article which comprises needling a mat made of glass fiber strands, impregnating it with a thermoplastic resin, pressing the impregnated mat into a sheet, and stamping the sheet at a flow temperature of the thermoplastic resin. In the mat used in the process, glass fibers are bundled in strands which are opened into monofilaments.

Japanese Patent Publication No. 13714/1973 states a thermoplastic resin impregnated lofty glass fiber mat. The lofty mat here referred to is an intermediate product before obtaining a final molded article by heating and compressing, and not a final product itself.

Japanese Laid-open Patent Application No. 161529/1987 describes that a sheet made of a thermoplastic material containing reinforcing fibers is preheated and expanded, and the expanded sheet is then molded into an article of a predetermined shape having portions of different density in a compression mold. It merely describes that the thermoplastic sheet containing the reinforcing fibers is expanded in the intermediate step for obtaining the final molded article.

It is an object of this invention to provide a lightweight composite molded article excellent in rigidity, heat resistance, moldability, acoustical properties and flexural strength and especially suitable as an automobile ceiling material.

Another object of this invention is to provide a process for producing the composite molded article with high productivity at low cost.

In one embodiment, this invention provides a composite material made of a nonwoven fibrous mat wherein inorganic monofilaments having a length of 10 to 200 mm and a diameter of 2 to 30 micrometers are partially bonded with a thermoplastic resin binder, many voids being provided throughout the mat and a large number of fine holes communicating with the voids in the inside being formed in at least one surface of the mat.

Examples of the inorganic monofilaments used in this invention are glass fibers, rock wool, ceramic fibers and carbon fibers. Of these, the glass fibers are preferable. The monofilaments are obtained by opening glass fiber strands being bundles of many filaments. The length of the monofilament is preferably 10 to 200 mm from the aspect of moldability of the mat. More preferable is to contain 70% by weight or more of monofilaments having a length of 50 mm or more. Regarding the diameters of the monofilament, the lower the diameter the lower the mechanical strengths. As the diameter is greater, the mat goes heavier and the bulk density becomes higher. Thus, the diameter is 2 to 30, preferably 5 to 20 micrometers, more preferably 7-13 micrometers.

Examples of the binder to partially bond the inorganic monofilaments include thermoplastic resins such as polyethylene, polypropylene, saturated polyesters, polyamides, polystyrene, polyvinyl butyral and polyurethane. The binder may take any form of a fiber, powder, solution, suspension, emulsion or film, and is used in a suitable form depending on a process for producing a molded article in this invention.

Regarding the ratio of the inorganic monofilaments to the binder, when the amount of the binder becomes small, a bonded portion decreases and mechanical strengths of a molded article reduce. Meanwhile, when it becomes large, a void ratio decreases. A preferable weight ratio is 1:5 to 5:1.

The molded article of this invention is made of a nonwoven fibrous mat wherein the inorganic monofilaments are partially bonded with a binder, many voids being provided throughout the mat. When the density of the molded article increases, it becomes heavy, and when it decreases, the mechanical strengths decrease. The preferable density is thus 0.01 to 0.2 g/cm$^3$. A void ratio as a whole is preferably 70 to 98%.

A large number of fine holes communicating with the voids in the inside are formed in at least one side of the molded article. The diameter of the holes is mostly 2 to 50 micrometers, and the density of the holes is preferably 1 to 10 holes/cm$^2$.

It is advisable that the binder to bond the inorganic monofilaments is more densely distributed on the surface than in the inside of the molded article, and the void ratio of the surface is lower than that of the inside. It is preferable that the void ratio of the surface is 50 to 95% and that of the inside is 85 to 99%.

The thickness of the molded article may properly be determined depending on the usage. It is usually 4 to 200 mm, and when the molded article is used as an automobile ceiling material, it is preferably 4 to 12 mm.

The composite molded article of this invention has the aforesaid structure. It may be laminated with films, foamed sheets or metal sheets. Or tackifier or adhesive layers may be laminated on the surface of the molded article so that the molded article is easy to adhere to other products. Or closed-cell or open-cell foams such as a polyethylene foam, a polypropylene foam, a polyurethane foam and a rubber foam or decorative skin materials such as woven and nonwoven fabrics and vinyl chloride leathers may be laminated thereon.

In another embodiment, this invention provides a first process for producing the aforesaid composite molded article which comprises forming a nonwoven fibrous mat composed of inorganic monofilaments having a length of 10 to 200 mm and a diameter of 2 to 30 micrometers and a fibrous and/or powdery thermoplastic resin binder, heating the mat above the melting point of the thermoplastic resin binder, compressing the mat at said temperature, then releasing the compression, recovering the thickness of the mat to obtain a heat-moldable composite sheet, and heat-molding the resulting composite sheet.

In the above process, the fibrous or powdery thermoplastic resin binder is used. Both the fibrous and powdery binders may conjointly be used. Examples of the thermoplastic resin used are as described above. Two or more of the thermoplastic resins may conjointly be used; on this occasion, it is advisable that their melting points are approximate to each other.

The fibers of the above thermoplastic resin have a length of preferably 5 to 200 mm, more preferably 20 to 100 mm and a diameter of preferably 3 to 50 micrometers, more preferably 20 to 40 micrometers from the aspect of excellent moldability in forming a mat by combining with the inorganic monofilaments.

A diameter of the powder made of the thermoplastic resin is preferably 50 to 100 mesh when it is added as such. However, when the powder is added in dispersion or emulsion, the diameter may be much smaller.

In the process of this invention, a type, a form and a size of the inorganic monofilaments and a ratio of the inorganic monofilaments to the thermoplastic resin binder are as noted above.

The mat may be produced by any method. There is, for example, a method which comprises feeding either fibers or a powder of a thermoplastic resin and inorganic fiber strands to a carding machine, and opening the strands into monofilaments to produce a mat. When the powder of the thermoplastic resin is used, it may be scattered on the mat as such or in dispersion or emulsion and then dried after the mat may be formed from the inorganic monofilaments or if required, from the inorganic monofilaments and the thermoplastic resin fibers.

To improve mechanical strengths of the mat, the mat may be needle-punched. It is advisable that the mat is needle-punched at 1 to 50 portions per square centimeter.

The higher the density of the mat, the heavier the mat. The lower the density of the mat, the lower its mechanical strengths. Accordingly, the density of the mat is preferably 0.01 to 0.2 g/cm$^3$, more preferably 0.03 to 0.07 g/cm$^3$.

In this invention, the mat is heated at a temperature above the melting point of the thermoplastic resin and then compressed at said temperature.

By the above heating, the thermoplastic resin is melted to bond the inorganic monofilaments to each other. It is advisable that the thermoplastic resin is all melted and the heating is therefore conducted at a temperature 10° to 70° C. higher than the melting point of the thermoplastic resin for 1 to 10 minutes.

A heating method may be any method such as a heating method with a dryer or a radiation heating method with a far infrared heater or an infrared heater.

After the above heating, the mat is compressed while the thermoplastic resin is melted. A compression method may be any method such as compression with a press or compression with rolls.

A pressure in the press compression is preferably 0.1 to 10 kg/cm$^2$, more preferably 3 to 4 kg/cm$^2$. A clearance between rolls in the roll compression is preferably 1/5 to 1/20, more preferably $\frac{1}{8}$ to 1/15 of the thickness of the mat. When the thermoplastic resin is cooled and solidified in the compression, the thickness of the mat is not recovered in the next step. It is therefore advisable that the press molds and the rolls are both heated.

By the compression, the molten thermoplastic resin is uniformly dispersed between the inorganic monofilaments.

The compression is then released and the thickness of the mat is recovered.

One method for recovering the thickness of the mat is that the compression-released mat is maintained at a temperature above the melting point of the binder for a given period of time. The maintaining time is preferably 10 seconds to 5 minutes, more preferably 20 seconds to 2 minutes. Another method for recovering the thickness of the mat is that the compression-released mat is mechanically pulled while the binder is melted. Such mechanical pulling is performed such that the mat is laminated in advance of the compression step with sheets which are melt-adhered to the molten binder but not to the non-molten binder and while the binder is in molten state after releasing the compression, the sheets bonded to the mat surface by melt adhering with the binder are pulled outwardly manually or by vacuum suction. Examples of the sheet which are melt-adhered to the molten binder but not to the non-molten binder are glass fiber reinforced polytetrafluoroethylene sheets, sheets whose surface is treated with polytetrafluoroethylene and polyester sheets whose surface is subjected to mold release treatment.

The mat with the thickness recovered is cooled to obtain a heat-moldable composite sheet. When the aforesaid sheets are used to recover the thickness, the binder becomes non-molten by cooling and the sheets are therefore easy to peel off from the surface of the composite sheet after cooling.

The heat-moldable composite sheet can easily be molded by heating it at a temperature above the melting point of the resin component and compressing the heated sheet via a press. When in compressing the sheet via the press the temperature of the pres is higher than the melting point of the resin component, the composite molded article is adhered to the press and hard to withdraw: the molding speed is lowered. For this reason, the pressing temperature is preferably lower than the melting point of the resin component, more preferably 30° to 100° C. lower than the melting point of the resin component.

In this manner, the composite molded article of the given shape is obtained. In the thus obtained composite molded article, the inorganic monofilaments are bonded to each other at their crosses with the binder, many voids are provided throughout the mat and a large number of fine holes communicating with the voids in the inside are formed in the surface of the mat.

In the first process of this invention, two or more thermoplastic resins different in melting point can be used as a fibrous thermoplastic resin binder and the heating temperature of the mat be a temperature at which the resin of the lower melting point is melted but the resin of the higher melting point is not. Consequently, part of the binder remains as such without being melted, thereby improving thickness recovery properties of the mat in the thickness recovering step.

In said process, the binder is more densely distributed on the surface of the mat whereby the void ratio of the surface can be rendered lower than that in the inside of the mat. A method in which the binder is more densely distributed on the surface of the mat is that after formation of the mat, a fibrous or powdery binder is additionally scattered on the surface of the mat.

In the process, in order to improve the mechanical properties, thermoplastic films such as polyethylene, polypropylene and saturated polyesters may be laminated on one or both sides of the heat-moldable composite sheet before heat-molding, by heat-fusing or extrusion-laminating. Moreover, for improving acoustical properties, a large number of holes may be formed in the films.

In still another embodiment, this invention provides a second process for producing the composite molded article of this invention which comprises forming a nonwoven fibrous mat from only inorganic monofilaments having a length of 10 to 200 mm and a diameter of 2 to 30 micrometers or said inorganic monofilaments and a fibrous and/or powdery thermoplastic resin binder, laminating one or more thermoplastic resin films on at least one side of the nonwoven fibrous mat, heating the laminated sheet at a temperature above a melting point of at least one of the thermoplastic resin films, compressing the laminated sheet at said temperature, then releasing the compression, recovering the thickness of the laminated sheet to obtain a heat-moldable composite sheet, and heat-molding the resulting composite sheet.

In the second process, one or more thermoplastic resin films are laminated on one or both sides of the nonwoven fibrous mat composed of inorganic monofilaments having a length of 10 to 200 mm and a diameter of 2 to 30 micrometers. The nonwoven fibrous mat may contain a fibrous or powdery thermoplastic resin binder.

Usually, the same thermoplastic resin films are laminated on both sides of the nonwoven fibrous mat. However, thermoplastic resin films different in melting point may also be laminated on both sides of the nonwoven fibrous mat. For instance, the melting point of the thermoplastic resin film being laminated on one side of the mat can be 10° to 50° C. higher than that of the thermoplastic resin film being laminated on another side of the mat. In this case, the laminated sheet is heated at an intermediate temperature between the melting points of both the resin films. By the heating, the resin is melted and impregnated in the fibrous mat on the side on which the resin film of the lower melting point has been laminated, with the result that a large number of small holes are formed in said side. Meanwhile, the resin film is retained in film form on the side on which the the resinous film of the higher melting point has been laminated.

Thermoplastic resin films approximately identical in melting point but different in melt index (MI) can be laminated on both sides of the nonwoven fibrous mat. For instance, a resin film having MI of 2 to 40 g/10 min can be laminated-on one side of the mat and a resin film having MI of 1 to 7 g/10 min on another side thereof. Where such laminated sheet is heated at a temperature above the melting points of the thermoplastic resin films, the thermoplastic resin of higher MI tends to be more impregnated in the fibrous mat than the thermoplastic resin of lower MI because of difference in flowability of the resins laminated on both sides. Accordingly, by properly selecting the heating and compressing conditions, the thermoplastic resin can be impregnated in one side of the mat to form a large number of small holes in said side and the thermoplastic resin be maintained in film state on another side.

It is possible that two or more thermoplastic resin films are laminated on one side of the nonwoven fibrous mat and MI's of the two or more thermoplastic resin films are increased sequentially from the outer layer to the inner layer. When the resulting laminated sheet is heated and compressed, the resin film laminated on the innermost layer is impregnated in the inside of the mat because of the highest MI. On the other hand, the resin film laminated on the outermost layer is retained in the vicinity of the surface of the mat because of the lowest MI. Consequently, the resin is distributed more densely on the surface portion than on the central portion of the mat.

It is also possible that two or more thermoplastic resins are laminated on one side of the nonwoven fibrous mat and the melting points of the two or more resin films are lowered sequentially from the outer layer to the inner layer. Where the resulting laminated sheet is heated and compressed, the resin film laminated on the innermost layer is impregnated in the inside of the mat, while the resin film laminated on the outermost layer is maintained on the surface of the mat. Consequently, the resin is distributed more densely on the surface portion than on the central portion of the mat.

Besides, the molten resin can be impregnated more densely in the surface portion than in the inside of the mat by controlling the pressure and time of the compression step and releasing the compression before the molten resin of the thermoplastic resin film is uniformly impregnated up to the inside.

Examples of the thermoplastic resin film being laminated on the nonwoven fibrous mat are films of thermoplastic resins such as polyethylene, polypropylene, polystyrene, saturated polyesters, polyurethane, polyvinyl butyral and polyvinyl chloride. These resin films can be used singly or in combination. As stated above, when the fibrous or powdery thermoplastic resin binder is used in the fibrous mat, a binder having a melting point which is the same as or lower than the melting point of the resin film is preferable. In order to improve the bulk density of the mat, a binder having a higher melting point than that of the resin film is available.

As the thickness of the thermoplastic resin film is higher, it becomes heavier. Meanwhile, as the thickness of the thermoplastic resin film is lower, the mechanical strengths decrease. The preferable thickness is therefore 10 to 300 micrometers. Where the fibrous or powdery resin binder is conjointly used, the inorganic monofilaments are bonded with said fibers or powder, making it possible to thin the thermoplastic resin film.

The thermoplastic resin film may be laminated by any optional method such as heat-fusing or extrusion-laminating.

The laminated sheet composed of the nonwoven fibrous mat and the thermoplastic resin films is heated at a temperature above the melting point of at least one thermoplastic resin film and compressed at said temperature, the compression is then released and the thickness is recovered to obtain the heat-moldable composite sheet, followed by heat-molding it. The steps of compressing the laminated sheet, releasing the compression, recovering the thickness and heat-molding the composite sheet are approximately the same as those in the first process.

During the heating and compressing steps, the thermoplastic resin films are melted and impregnated in the inorganic fibrous mat. Thus, the inorganic monofilaments are bonded to each other at their crosses by the resin component, many voids are provided throughout the mat and a large number of fine holes communicating with the voids in the inside are formed in the surface of the mat by melting and impregnating the resin films, thereby improving acoustical properties of the molded article. By the way, the large number of the fine holes are formed in the heat-moldable composite sheet, and also in heat-molding the resin on the surface is melted to form fine holes. For further increasing the number of such fine holes, holes may be formed in the surface of the composite molded article by e.g. a needle.

In the first and second processes of this invention, it is possible that a closed-cell thermoplastic resin foam having preferably many penetration holes and a decorative skin material preferably having air-permeability are sequentially laminated on one side of the mat or heat-moldable sheet before the heat-molding step, and the resulting laminate is then heat molded. The thus obtained composite molded article is useful especially as an automobile ceiling material.

Examples of the thermoplastic resin foam are foams of polyolefin resins such as polyethylene and polypropylene, an ethylene/vinyl acetate copolymer foam and a polyvinyl chloride resin foam. Especially, the polyolefin resin foam containing the ethylene/vinyl acetate copolymer is preferable owing to good adhesion.

Such foam has preferably compression strength (measured according to JIS K 6767) of 0.1 to 2.0 kg/cm$^2$. When the compression strength decreases, pressing is not thoroughly conducted and adhesion strength decreases. Meanwhile, when the compression strength increases, no sufficient cushioning properties are obtained.

It is preferable that the above foam is provided with many penetration holes and the penetration hole has a diameter of 0.1 to 5.0 mm and an opening ratio of 0.5 to 30%. Where the diameter is smaller than 0.1 mm and the opening ratio is lower than 0.5%, acoustical properties decrease. On the other hand, where the diameter is larger than 5.0 mm and the opening ratio is higher than 30%, the uniform smoothness of the surface is lost.

When the foam is thin, the cushioning properties are insufficient. When it is thick, the delicate moldability of the surface is poor. The thickness of the foam is therefore preferably 0.5 to 5.0 mm, more preferably 1.0 to 3.0 mm.

The decorative skin material being integrally laminated on the foam surface has preferably airpermeability, and woven and nonwoven fabrics are generally available as the air-permeable decorative skin material.

The above closed-cell foam and the decorative skin material are laminated sequentially on one side of the nonwoven fibrous mat or laminated sheet, and they are bonded to each other and integrated.

On this occasion, an adhesive such as a hot-melt adhesive may be coated on the foam and the decorative skin material to such extent that the air-permeability is not impaired, followed by sequentially laminating them. Or the foam and the decorative skin material may be bonded in advance via heat-bonding or with an adhesive such as a hot melt adhesive to such extent that the air-permeability is not so much impaired. An open-cell soft polyurethane foam may be interleaved between the mat or the heat-moldable composite sheet and the decorative skin material.

Since the composite molded article of this invention is formed of the nonwoven fibrous mat wherein the inorganic monofilaments are partially bonded with the thermoplastic resin binder, sufficient strength and heat resistance and higher void ratio than in the conventional molded articles are achieved and high acoustical properties are therefore obtained.

The composite molded article of this invention is preferably produced by a process which comprises once heating and compressing the mat wherein the inorganic monofilaments are partially bonded with a resinous, powdery and/or film-like thermoplastic resin, then recovering the thickness of the mat, and conducting heat-molding. The high strength is provided by bonding the inorganic monofilaments to the binder resin upon heating and compressing, and the sufficient void ratio is attained by the subsequent thickness recovering. In addition, since the binder resin is impregnated from the surface into the inside of the inorganic fibrous mat and subjected to heat-molding, the large number of the fine holes communicating with the voids in the inside are formed in the surface of the mat to provide the high acoustical properties.

The nonwoven fibrous heat-moldable composite sheet obtained via the heating, compressing and thickness recovering steps has good heat-moldability and is easily molded into a desirable shape by a simple processing means such as a press; a molded article having a curvature corresponding to a curvature of a mold can be afforded.

The following Examples and Comparative Examples illustrate this invention more specifically.

EXAMPLE 1

Glass fiber chopped strands (length of 50 mm, monofilament diameter of 10 micrometers) and high-density polyethylene fibers (diameter of 30 micrometers, length of 50 mm, melting point of 135° C., MI of 5) were fed at a weight ratio of 4:1 to a carding machine where the glass fiber chopped strands were opened into monofilaments. Both were then combined into a mat-like material. The mat-like material was needle-punched at 30 portions per square centimeter to obtain a nonwoven fibrous mat having a thickness of 10 mm.

High-density polyethylene sheets (thickness of 100 micrometers, melting point of 135° C., MI of 5) were laminated on both sides of the nonwoven fibrous mat. Glass fiber reinforced polytetrafluoroethylene sheets (thickness of 150 micrometers) were laminated on both sides of the mat. The laminate was heated at 200° C. for 3 minutes and then compressed into a sheet with a press of 200° C. at a pressure of 10 kg/cm$^2$. In this case, the thickness of the laminate was 0.6 mm. The compression time was 20 seconds. After releasing the compression, the polytetrafluoroethylene sheets on both sides were sucked in vacuo while maintaining the temperature at 200° C., and the thickness of the laminated sheet was recovered up to 9 mm. Subsequently, the laminated sheet was cooled with air for 3 minutes, and the polytetrafluoroethylene sheets were then peeled off to afford a heat-moldable composite sheet.

The resulting composite sheet was heated in an oven of 200° C. for 2 minutes and compressed with a mold of 30° C. for 1 minute at a compression force of 1 kg/cm$^2$ to obtain a molded article. The mold had the thinnest portion of 3 mm and the thickest portion of 8 mm. A curvature radius of a recessed portion in the mold was 5 mm. The resulting molded article was a tray-like molded article 1400 mm long and 1150 mm wide.

An average void ratio of the molded article was 90%, a void ratio of the surface portion 70%, and a void ratio of the central portion 95% respectively. A hole density of the surface was 50 holes/cm$^2$, the hole diameter was 2 to 100 micrometers, and most of the holes had a diameter of 30 to 40 micrometers.

The resulting molded article was subjected to a flexural test according to JIS K 7221 (the test piece had a thickness of 5 mm, a width of 50 mm and a length of 150 mm) and measured for heat moldability (a curvature radius of a portion in the molded article corresponding to the curvature radius, 5 mm of the recessed portion in the mold) and acoustical properties by a vertical incidence method according to JIS A 1405. The results are tabulated below.

| | |
|---|---|
| Maximum flexural load (kg) | 1.7–2.0 |
| Flexural strength (kg/cm$^2$) | 35–40 |
| Flexural modulus (kg/cm$^2$) | 3000–4000 |
| Heat-moldability (Curvature radius: mm) | 5.5 |
| Acoustical properties (%) | |
| 0.80 KHz | 67 |
| 1.00 KHz | 81 |
| 1.25 KHz | 81 |
| 1.60 KHz | 80 |
| 2.00 KHz | 78 |

EXAMPLE 2

Glass fiber chopped strands (length of 50 to 100 mm, monofilament diameter of 10 micrometers) and polyethylene fibers (length of 51 mm, diameter of 30 micrometers, melting point of 135° C., MI of 20) were fed at a weight ratio of 1:2 to a carding machine where the glass fiber chopped strands were opened into monofilaments. Both were combined into a mat-like material. The mat-like material was needle-punched at 20 portions per square centimeter to obtain a mat having a thickness of 10 mm and a weight of 800 g/m$^2$.

The resulting mat was fed to a hot-air dryer where it was dried at 200° C. for 3 minutes. Subsequently, the heated mat was compressed through rolls with a clearance between rolls of 1 mm. The compressed mat was fed again to the hot-air dryer where it was maintained at 200° C. for 3 minutes. There resulted a heat-moldable composite sheet having a thickness of 8 mm.

Both sides of the resulting composite sheet were heated with a infrared heater of 200° C. for 3 minutes and fed to a mold having a depth of 10 mm, a clearance between molds of 5 mm and a curvature radius of a recessed portion of 5 mm (mold temperature of 25° C.) where the composite sheet was pressed at a pressure of 0.05 to 1.0 kg/cm$^2$ for 2 minutes to obtain a tray-like molded article.

The resulting molded article was measured for flexural strength and flexural modulus (according to JIS K 7221), heat moldability (a curvature radius of a portion in the molded article corresponding to the curvature radius, 5 mm of the recessed portion in the mold), dimensional stability (shrinkage after heating with a hot-air dryer of 90° C. for 100 hours) and acoustical properties by a vertical incidence method according to JIS A 1405 (1 KHz). The results are shown in Table 1.

EXAMPLE 3

Glass fiber chopped strands (length of 50 to 100 mm, monofilament diameter of 10 micrometers) and polyethylene fibers (length of 51 mm, diameter of 30 micrometers, melting point of 135° C., MI of 20) were fed at a weight ratio of 1:1 to a carding machine where the glass fiber chopped strands were opened into monofilaments. Both were combined into a mat-like material. The mat-like material was needle-punched at 20 portions per square centimeter to obtain a mat having a thickness of 10 mm and a weight of 700 g/m$^2$.

In the same way as in Example 2, the resulting mat was heated, compressed through the rolls spaced apart at an interval of 1 mm and further heated, followed by recovering the thickness. There was obtained a mat having a thickness of 7 mm. Polyethylene (melting point of 135° C., MI of 5) was extrusion-laminated onto both sides of the resulting mat to provide a heat-moldable composite sheet. Each of the polyethylene layers was 50 g/m$^2$.

In the same way as in Example 2, a molded article was produced from the resulting composite sheet and then measured for various properties. The results are shown in Table 1.

COMPARATIVE EXAMPLE 1

The mat obtained in Example 3 was fed to a hot-air dryer where it was heated at 200° C. for 3 minutes. The heated mat was then compressed via rolls spaced apart at an interval of 1 mm, and left to cool. There was obtained a mat having a thickness of 2.5 mm. Polyethylene (melting point of 135° C., MI of 5) was extrusion-laminated onto both sides of the resulting mat to provide a heat-moldable composite sheet. Each of the polyethylene layers was 50 g/m$^2$.

A molded article was obtained from the resulting composite sheet as in Example 2 except that a clearance between molds was 2 mm, and measured for various properties as in Example 2. The results are shown in Table 1.

EXAMPLE 4

Glass fiber chopped strands (length of 50 to 100 mm, monofilament diameter of 10 micrometers) and a polyethylene powder (diameter of 10.0 to 200 micrometers, melting point of 135° C., MI of 5) were fed at a weight ratio of 1:1 to a carding machine where the glass fiber chopped strands were opened into filaments. Both were combined into a mat-like material. The mat-like material was needle-punched at 20 portions per square centimeter to obtain a mat having a thickness of 7 mm and a weight of 700 g/m$^2$.

In the same way as in Example 3, the resulting mat was heated, compressed via rolls, and then heated to obtain a mat having a thickness of 6 mm. Polyethylene was extrusion-laminated on both sides of the mat to afford a heat-moldable composite sheet.

In the same way as in Example 2, a molded article was obtained from the resulting composite sheet and measured for various properties. The results are shown in Table 1.

EXAMPLE 5

Glass fiber chopped strands (length of 40 to 200 mm, monofilament diameter of 9 to 13 micrometers) and polyethylene fibers (length of 51 mm, diameter of 30 micrometers, melting point of 135° C., MI of 20) were fed at a weight ratio of 1:2 to a carding machine where the glass fiber chopped strands were opened into monofilaments. Both were combined into a mat-like material. The mat-like material was needle-punched at 20 portions per square centimeter to obtain a mat having a thickness of 10 mm and a weight of 800 g/m$^2$. Glass fiber reinforced polytetrafluoroethylene sheets (thickness of 150 micrometers) were laminated on both sides of the mat, heated at 200° C. for 3 minutes and compressed with rolls heated at 200° C. and spaced apart at an interval of 1.3 mm. Subsequently, the compression was released. While maintaining the temperature at 200° C., the glass fiber reinforced polytetrafluoroethylene sheets were sucked in vacuo from both sides at a rate of 0.5 mm/second to recover the thickness of the mat up to 9 mm. Subsequently, the mat was cooled with air for 3 minutes and the polytetrafluoroethylene sheets were peeled off to obtain a heat-moldable composite sheet.

The resulting composite material was heated in an oven of 200° C. for 2 minutes and then compressed with a mold of 30° C. at a compression force of 1 kg/cm$^2$ for 1 minute to provide a molded article. The mold had the thinnest portion of 3.0 mm and the thickest portion of 8.0 mm. A curvature radius of a recessed portion in the mold was 5 mm. The molded article was 1400 mm long and 1150 mm wide.

The resulting molded article was fed to a hot-air dryer held at 95° C. where it was dried for 24 hours while holding all sides thereof. At this time, a heat distortion resistance (amount of sagging) was measured. Further, a flexural strength was measured according to JIS K 7221 (the test piece had a thickness of 6 mm, a width of 50 mm and a length of 150 mm). Still further, acoustical properties at 1500 Hz was measured by a vertical incidence method according to JIS A 1405. A heat moldability of the composite material was evaluated by measuring a curvature radius of a portion in the molded article corresponding to the curvature radius, 5 mm of the recessed portion in the mold. The results are shown in Table 2.

EXAMPLE 6

Glass fiber chopped strands (length of 50 to 100 mm, monofilament diameter of 10 micrometers) and polyethylene fibers (length of 51 mm, diameter of 30 micrometers, melting point of 135° C., MI of 20) were fed at a weight ratio of 3:1 to a carding machine where the strands were opened into monofilaments. Both were combined into a mat-like material. The mat-like material was needle-punched at 20 portions per square centimeter. Subsequently, polyethylene films (melting point of 135° C., MI of 5, weight of 100 g/m$^2$) were laminated on both sides of the mat to form a laminated sheet having a thickness of 10 mm and a weight of 800 g/m$^2$.

The resulting laminated sheet was fed to a hot-air dryer where it was heated at 200° C. for 3 minutes. Thereafter, the sheet was compressed via rolls spaced apart at an interval of 1 mm, and fed again to the hot-air dryer where it was maintained at 200° C. for 3 minutes. There was obtained a heat-moldable composite sheet having a thickness of 7 mm.

Both sides of the resulting composite sheet were heated with an infrared heater of 200° C. for 3 minutes. The sheet was fed to a mold having a depth of 10 mm, a clearance between molds of 5 mm and a curvature radius of a recessed portion of 5 mm (mold temperature of 25° C.) where it was pressed at a pressure of 0.05 to 1.0 kg/cm$^2$ for 2 minutes. There resulted a tray-like molded article.

The resulting molded article was measured for flexural strength, flexural modulus, moldability, dimensional stability and acoustical properties in the same way as in Example 2. The results are shown in Table 1.

EXAMPLE 7

Glass fiber chopped strands (length of 50 to 100 mm, monofilament diameter of 10 micrometers) and a polyethylene powder (diameter of 100 to 200 micrometers, melting point of 135° C., MI of 5) were fed at a weight ratio of 2:1 to a carding machine where the strands were opened into monofilaments. Both were combined into a mat-like material. The mat-like material was needle-punched at 20 portions per square centimeter and then polyethylene films (melting point of 135° C., MI of 5, weight of 100 g/m$^2$) were laminated on both sides of the mat-like material to obtain a laminated sheet having a thickness of 10 mm and a weight of 800 g/m$^2$.

In the same way as in Example 6, the resulting laminated sheet was heated, compressed via rolls and then heated to afford a heat-moldable composite sheet having a thickness of 7 mm. In the same way as in Example 6, a molded article was produced from the composite sheet and measured for various properties. The results are shown in Table 1.

EXAMPLE 8

Glass fiber chopped strands (length of 50 to 100 mm, monofilament diameter of 10 micrometers) were fed to a carding machine where the strands were opened into monofilaments. They were combined into a mat-like material. The mat-like material was needle-punched at 20 portions per square centimeter. Subsequently, polyethylene films (melting point of 135° C., MI of 5, weight of 150 g/m$^2$) were laminated on both sides of the mat-like material to obtain a laminated sheet having a thickness of 10 mm and a weight of 800 g/m$^2$.

In the same way as in Example 6, the resulting laminated sheet was heated, compressed via rolls and then heated to afford a heat-moldable composite sheet having a thickness of 7 mm.

In the same way as in Example 6, a molded article was obtained from the thus obtained composite sheet and measured for various properties. The results are shown in Table 1.

COMPARATIVE EXAMPLE 2

The laminated sheet obtained in Example 6 was fed to a hot-air dryer where it was heated at 200° C. for 3 minutes. The resulting sheet was then compressed via rolls spaced apart at an interval of 1 mm and allowed to cool. There was obtained a composite sheet having a thickness of 2.5 mm.

A molded article was obtained from the resulting composite sheet as in Example 6 except that an interval between molds was 2 mm, and measured for various properties as in Example 6. The results are shown in Table 1.

EXAMPLE 9

Glass fiber chopped strands (length of 40 to 200 mm, monofilament diameter of 9 to 13 micrometers) were fed to a carding machine where said strands were opened into monofilaments. They were combined into a mat-like material. The mat-like material was needle-punched at 20 portions per square centimeter to obtain a mat having a thickness of 10 mm and a weight of 600 g/m$^2$. Polyethylene sheets (thickness of 10 micrometers, weight 100 g/m$^2$, melting point of 135° C., MI of 5) were laminated on both sides of the mat to afford a laminated sheet. Glass fiber reinforced polytetrafluoroethylene sheets (thickness of 150 micrometers) were laminated on both sides of the resulting laminated sheet, heated at 200° C. for 3 minutes and compressed at a rate of 10 cm/sec via rolls heated at 200° C. and spaced apart at an interval of 1.3 mm. Thereafter the compression was released, and while keeping the temperature at 200° C., the glass fiber reinforced polytetrafluoroethylene sheets were sucked in vacuo from both sides at a rate of 0.5 mm/sec to recover the thickness of the laminated sheet up to 8 mm. The laminated sheet was then cooled with air for 3 minutes, followed by peeling off the tetrafluoroethylene sheets. There resulted a heat-moldable composite sheet.

The resulting composite sheet was heated in an oven of 200° C. for 2 minutes and then compressed with a mold of 30° C. at a compression force of 1 kg/cm$^2$. The mold has the thinnest portion of 3.0 mm and the thickest portion of 8.0 mm. A curvature radius of the recessed portion in the mold was 5 mm. The molded article was 1400 mm long and 1150 mm wide.

The molded article was measured for various properties in the same way as in Example 5. The results are shown in Table 2.

EXAMPLE 10

Glass fiber chopped strands (length of 40 to 200 mm, monofilament diameter of 9 to 13 micrometers and polyethylene fibers (length of 50 mm, diameter of 30 micrometers, melting point of 135° C., MI of 20) were fed at a weight ratio of 4:1 to a carding machine where the glass fiber strands were opened into monofilaments. Both were combined into a mat-like material. The mat-like material was needle-punched at 20 portions per square centimeter to obtain a mat having a thickness of 10 mm and a weight of 600 g/m$^2$. Polyethylene sheets (thickness of 100 micrometers, weight of 100 g/m$^2$, melting point of 135° C., MI of 5) were laminated on both sides of the mat to afford a laminated sheet. Glass fiber reinforced polytetrafluoroethylene sheets (thickness of 150 micrometers) were laminated on both sides of the laminated sheet, heated at 200° C. for 3 minutes and compressed with a flat press at a pressure of 10 kg/cm$^2$ for 30 seconds. After releasing the compression, the polytetrafluoroethylene sheets on both sides were sucked in vacuo while keeping the temperature at 200° C. to recover the thickness of the laminated sheet up to 9 mm. Thereafter, the laminated sheet was cooled with air for 3 minutes and the polytetrafluoroethylene sheets were then peeled off to obtain a heat-moldable composite sheet.

The resulting composite sheet was heated in an oven of 200° C. for 2 minutes and then compressed with a mold of 30° C. at a compression force of 1 kg/cm$^2$ for 1 minute to provide a molded article. The mold had the thinnest portion of 3 mm and the thickest portion of 8 mm. A curvature radius of a recessed portion in the mold was 5 mm. The molded article was 1400 mm long and 1150 mm wide.

The molded article was measured for various properties as in Example 5. The results are shown in Table 2.

TABLE 1

| | | Flexural strength (kg/cm$^2$) | Flexural modulus (kg/cm$^2$) | Moldability (curvature radius) (mm) | Dimensional stability (%) | Acoustical properties (1 KHz) (%) |
|---|---|---|---|---|---|---|
| Example | 2 | 15–20 | 3000–4000 | 5.5 | 0.06 | 78 |
| | 3 | 20–30 | 3500–4500 | 5.5 | 0.07 | 65 |
| | 4 | 15–25 | 3500–4000 | 5.5 | 0.08 | 62 |
| | 6 | 25–30 | 3500–4500 | 5.5 | 0.07 | 65 |
| | 7 | 15–25 | 3000–3500 | 5.5 | 0.08 | 62 |
| | 8 | 20–30 | 3500–4500 | 5.5 | 0.06 | 67 |
| Comparative | 1 | 30–40 | 6000–8000 | 8.0 | 0.08 | 38 |

TABLE 1-continued

| | | Flexural strength (kg/cm²) | Flexural modulus (kg/cm²) | Moldability (curvature radius) (mm) | Dimensional stability (%) | Acoustical properties (1 KHz) (%) |
|---|---|---|---|---|---|---|
| Example | 2 | 30–40 | 6000–8000 | 8.0 | 0.08 | 37 |

TABLE 2

| Example | Heat distortion resistance (mm) | Flexural strength (Kg/cm2) | Acoustical properties (1.5 KHz) (%) | Heat moldability (curvature radius) (mm) |
|---|---|---|---|---|
| 5 | 1.7 | 20.1 | 90 | 5.4 |
| 9 | 1.5 | 18.9 | 92 | 5.5 |
| 10 | 1.3 | 19.1 | 91 | 5.2 |

Example 11

Sixty-five percent by weight of glass fiber strands (length of 40 to 100 mm, monofilament diameter of 9 to 13 micrometers) and 35% by weight of high-density polyethylene fibers (length of 40 to 100 mm, diameter of 6 denier, melting point of 135° C., MI of 20) were fed to a carding machine where the strands were opened into monofilaments. Both were combined into a mat-like material. The mat-like material was needle-punched at 15 portions per square centimeter to obtain a nonwoven fibrous mat having a thickness of 10 mm and a weight of 500 g/m².

Low-density polyethylene films (thickness of 150 micrometers, melting point of 107° C., MI of 5) were laminated on both sides of the nonwoven fibrous mat. The laminate was heated and compressed with a press of 120° C. at a pressure of 1 kg/cm² for 10 seconds to decrease the thickness. Thereafter, the compression was released and the laminate was held at 120° C. for 20 seconds to increase the thickness. There resulted a heat-moldable composite sheet having a thickness of 8.3 mm.

The above composite sheet was heated from both sides by an infrared heater until the surface temperature reached 170° C., and immediately placed into a mold of 30° C. where it was compression-molded into a final shape at a pressure of 1 kg/cm² for 1 minute. The mold had the thinnest portion of 2.5 mm and the thickest portion of 5.0 mm. A curvature radius of a recessed portion in the mold was 5 mm. A heat moldability was evaluated by measuring whether the molded article was shaped to correspond to the recessed portion in the mold.

The above molded article was measured for heat distortion resistance (amount of sagging) after heating it in a hot-air oven of 95° C. for 24 hours while holding all sides thereof. Further, from the above molded article, a test piece having a thickness of 5 mm, a width of 50 mm and a length of 150 mm was cut out and measured for flexural strength and flexural modulus according to JIS K 7221. Still further, from the molded article, a test piece having a thickness of 8 mm and a diameter of 90 mm was cut out and measured for acoustical properties at 1000 Hz by a vertical incidence method according to JIS A 1405. The results are shown in Table 3.

EXAMPLE 12

A heat-moldable composite sheet having a thickness of 8.7 mm was obtained in the same way as in Example 11 except that the high-density polyethylene fibers were replaced with polyester fibers (melting point of 160° C.).

A molded article was produced from the composite sheet as in Example 11 except that the surface temperature in molding the composite sheet into a final shape was changed into 200° C., and measured for various properties as in Example 11. The results are shown in Table 3.

TABLE 3

| Example | Flexural strength (kg/cm²) | Flexural modulus (kg/cm²) | Heat distortion resistance (mm) | Acoustical properties (%) (1 KHz) | Heat moldability |
|---|---|---|---|---|---|
| 11 | 15–20 | 3600–3900 | 1.3 | 71 | 5.4 |
| 12 | 15–20 | 3500–3700 | 2.0 | 68 | 5.5 |

EXAMPLE 13

Glass fiber chopped strands (length of 50 to 100 mm, monofilament diameter of 10 micrometers) and high-density polyethylene fibers (length of 51 mm, diameter of 30 micrometers, melting point of 135° C., MI of 20) were fed at a weight ratio of 3:1 to a carding machine where the strands were opened into monofilaments. Both were combined into a mat-like material. The mat-like material was needle-punched at 20 portions per square centimeter to obtain a mat.

High-density polyethylene films (melting point of 135° C., weight of 100 g/m², MI of 5) were laminated on both sides of the mat to form a laminated sheet having a thickness of 10 mm and a weight of 800 g/m². After heated in an oven of 200° C. for 3 minutes, the laminated sheet was compressed through a pair of rolls spaced apart at an interval of 1 mm. The compression was then released and the thickness was recovered while the laminated sheet was held again in the oven of 200° C. for 3 minutes. There resulted a heat-moldable composite sheet having a thickness of 7 mm.

In the heat-moldable composite sheet, the glass fibers were partially bonded with the molten high-density polyethylene fibers and films as binders, and many voids were formed throughout the sheet; air-permeability was therefore provided.

The heat-moldable composite sheet was heated at both sides with an infrared heater of 200° C. for 3 minutes. On one side of the heated heat-moldable composite sheet were rapidly laminated a closed-cell, crosslinked, low-density polyethylene foam (thickness of 2 mm, compression strength of 0.3 kg/cm²) provided with a large number of penetration holes each having a diameter of 1.5 mm at an opening ratio of 5.0% and a decorative skin material made of an air-permeable nonwoven fabric having a thickness of 1 mm in this order.

By the way, the foam and the nonwoven fabric were integrally bonded in advance to each other with a chloroprene-type hot melt adhesive so as not to impair air-permeability of the foam and the nonwoven fabric.

The above laminate was placed into a press (depth of 10 mm, clearance between molds of 8 mm, curvature radius of a recessed portion of 5 mm) held at 25° C. where it was pressed at a pressure of 0.2 kg/cm$^2$ for 25 seconds. There was obtained an automobile ceiling material.

The resulting automobile ceiling material had air-permeability; it was measured for heat moldability, heat resistance, flexural strength, acoustical properties and bonding strength. The results are shown in Table 4.

The heat moldability was evaluated by measuring a curvature radius of a portion in the ceiling material corresponding to the curvature radius, 5 mm of the recessed portion in the mold. The dimensional stability was evaluated by measuring shrinkage after the ceiling material was heated in an oven of 90° C. for 100 hours. The flexural strength was evaluated by cutting out a test piece having a thickness of 8 mm, a width of 100 mm and a length of 150 mm from the ceiling material and measuring it according to JIS K 7221. The acoustical properties were evaluated by cutting out a test piece having a thickness of 8 mm and a diameter of 90 mm from the ceiling material and measuring it through a vertical incidence method (1.5 KHz) according to JIS A 1405. The bonding strength was evaluated by peeling off the heat-moldable composite sheet and the foam at one end of the test piece 25 mm in width and 150 mm in length and conducting a 180° peel strength test (pulling rate of 300 mm/min).

EXAMPLE 14

Example 13 was repeated except that a crosslinked, low-density polyethylene foam having a compression strength of 1.0 kg/cm$^2$ was used and an open-cell, soft polyurethane foam having a compression strength of 0.03 kg/cm$^2$ and a thickness of 1 mm was interposed between the polyethylene foam and the decorative skin material and they were integrally bonded with an adhesive. The results are shown in Table 4.

TABLE 4

| Example | Heat moldability (mm) | Dimensional stability (%) | Flexural strength (kg/cm$^2$) | Acoustical properties (1.5 KHz) (%) | Adhesive strength (kg/25 mm width) |
|---|---|---|---|---|---|
| 13 | 5.7 | 0.07 | 17 | 72 | 2.0 (The polyethylene foam was destroyed.) |
| 14 | 5.8 | 0.09 | 18 | 71 | 5.7 (Part of the polyethylene foam was destroyed.) |

EXAMPLE 15

Glass fiber chopped strands (length of 40 to 200 mm, monofilament diameter of 9 to 13 micrometers) and polyethylene fibers (length of 50 mm, diameter of 30 micrometers, melting point of 135° C., MI of 5) were fed at a weight ratio of 4:1 to a carding machine where the strands were opened into monofilaments. Both were combined into a mat-like material. The mat-like material was needle-punched at 20 portions per square centimeter to obtain a mat having a thickness of 10 mm and a weight of 500 g/m$^2$. Polyethylene sheets (thicknesses of 100 micrometers and 200 micrometers, melting point of 135° C., MI of 5) were laminated on both sides of the mat to afford a laminated sheet. On both sides of the laminated sheet were laminated glass fiber reinforced polytetrafluoroethylene sheets (thickness of 150 micrometers). The laminate was heated while compressing it with a press comprising a lower mold of 200° C. (on the side of the 200-micrometer polyethylene sheet) and an upper mold of 50° C. (on the side of the 100-micrometer polyethylene sheet) at a pressure of 0.2 kg/cm$^2$ for 3 minutes. Detection with a heat label revealed that the polyethylene sheet portion on the lower mold side reached 200° C. and the polyethylene sheet portion on the upper mold side reached 115° C. It was found that the polyethylene sheet portion on the lower mold side was melted. Subsequently, the pressure of the press was elevated to 10 kg/cm$^2$ and the compression was conducted for 20 seconds. The polytetrafluoroethylene sheets on both sides were then sucked in vacuo at the above temperatures to recover the thickness of the laminated sheet up to 9 mm. Thereafter, the laminated sheet was cooled with air for 3 minutes, followed by peeling off the polytetrafluoroethylene sheets. There resulted a heat-moldable composite sheet. In the composite sheet, polyethylene was impregnated in the mat on the lower mold side and the polyethylene sheet remained in film form on the upper mold side.

The resulting composite sheet was heated to 200° C. on the lower mold side and to 120° C. on the upper mold side through an infrared heater. The sheet was compressed with a mold of 30° C. at a compression force of 1 kg/cm$^2$ for 1 minute to afford a molded article. The mold had the thinnest portion of 3.0 mm and the thickest portion of 8.0 mm. A curvature radius of a recessed portion in the mold was 5 mm. The molded article was 1400 mm long and 1150 mm wide. A large number of small holes were formed in the surface of the molded article on the upper mold side.

The resulting molded article was fed to a hot-air dryer set at 95° C. where it was heated for 24 hours while holding all sides thereof. At this time, a heat distortion resistance (amount of sagging) was measured. The flexural strength and the flexural modulus were evaluated by measuring a test piece having a thickness of 6 mm, a width of 50 mm and a length of 150 mm according to JIS K 7221. Acoustical properties at 1000 Hz was measured by a vertical incidence method according to JIS A 1405. An air-permeability was also measured. The results are shown in Table 5.

EXAMPLE 16

Glass fiber chopped strands (length of 40 to 200 mm, monofilament diameter of 9 to 13 micrometers, melting point of 135° C., MI of 5) and polyethylene fibers (length of 50 micrometers, diameter of 30 micrometers) were fed at a weight ratio of 4:1 to a carding machine where the strands were opened into filaments. Both were combined into a mat-like material. The mat-like material was needle-punched at 20 positions per square centimeter to obtain a mat having a thickness of 10 mm and a weight of 500 g/m$^2$. On both sides of the mat were laminated a polyethylene sheet (thickness of 200 micrometers, weight of about 200 g/m$^2$, melting point of 135, MI of 5) and a polypropylene sheet (thickness of 100 micrometers, weight of about 100 g/m$^2$, melting point of 165° C., MI of 1) to afford a laminated sheet. Glass fiber reinforced polytetrafluoroethylene sheets (thickness of 150 micrometers) were laminated on both sides of the laminated sheet, heated at 160° C. for 3 minutes and compressed with a flat press at a pressure of 10 kg/cm$^2$ for 20 seconds. The compression was released, and while the temperature was maintained at 160° C., the polytetrafluoroethylene sheets on both sides were then sucked in vacuo to recover the thickness of the laminated sheet up to 9 mm. Thereafter, the laminated sheet was cooled with air for 3 minutes, and the polytetrafluoroethylene sheets were then peeled off to obtain a heat-moldable composite sheet.

The resulting composite sheet was heated in an oven of 160° C. for 2 minutes, and then compressed with a mold of 30° C. at a compression force of 1 kg/cm$^2$ for 1 minute to provide a molded article. The mold had the thinnest portion of 3 mm and the thickest portion of 8 mm. A curvature radius of a recessed portion in the mold was 5 mm. The molded article was 1400 mm long and 1150 mm wide. A large number of small holes were formed in the molded article on the polyethylene side. A curvature radius of a portion in the molded article corresponding to the curvature radius, 5 mm of the recessed portion in the mold was 5.4 mm.

The resulting molded article was measured for various properties in the same way as in Example 15. The results are shown in Table 5.

The mat-like material was needle-punched at 30 portions per square centimeter to obtain a mat having a thickness of 10 mm and a weight of 500 g/m$^2$. On both sides of the mat were laminated polyethylene sheets (thickness of 150 micrometers, different MI: 0.5 and 15).

Glass fiber reinforced polytetrafluoroethylene sheets (thickness of 150 micrometers) were laminated on both sides of the resulting laminated sheet, heated at 160° C. for 3 minutes and compressed with a flat press at a pressure of 10 kg/cm$^2$ for 20 seconds. The compression was released and while maintaining the temperature at 160° C., the polytetrafluoroethylene sheets on both sides were then sucked in vacuo to recover the thickness of the laminated sheet up to 9 mm. Thereafter, the laminated sheet was cooled with air for 3 minutes, and the polytetrafluoroethylene sheets were then peeled off to provide a heat-moldable composite sheet. A large number of small holes were formed in the surface of the composite sheet on the side of the polyethylene sheet with MI of 15.

The resulting composite sheet was heated in an oven of 160° C. for 2 minutes and then compressed with a mold of 30° C. at a compression force of 1 kg/cm$^2$ for 1 minute to obtain a molded article. The mold had the thinnest portion of 3 mm and the thickest portion of 8 mm. A curvature radius of a recessed portion in the mold was 5 mm. The molded article was 1400 mm long and 1150 mm wide.

A curvature radius of a portion in the molded article corresponding to the curvature radius, 5 mm of the recessed portion in the mold, was 5.5 mm. The resulting molded article was measured for dimensional stability in the same way as in Example 2 and for various properties in the same way as in Example 15. 90° C. for 100 hours), acoustical properties in 1000 Hz by a vertical incidence method and an air-permeability were measured The results are shown in Table 5.

TABLE 5

| Example | Flexural strength (kg/cm$^2$) | Flexural modulus (kg/cm$^2$) | Heat moldability (curvature radius) (mm) | Heat distortion resistance (mm) | Acoustical Properties (%) | Air-permeability | Dimensional stability (%) |
|---|---|---|---|---|---|---|---|
| 15 | 25–27 | 3000–3100 | — | 1.7 | 65 | no | — |
| 16 | 24–27 | 3000–3400 | 5.4 | 1.5 | 65 | no | — |
| 17 | 25–30 | 3500–4000 | 5.5 | — | 65 | no | 0.7 |

EXAMPLE 17

Glass fiber chopped strands (length of 40 to 200 mm, monofilament diameter of 9 to 13 micrometers) and polyethylene fibers (length of 50 mm, diameter of 30 micrometers) were fed at a weight ratio of 4:1 to a carding machine where the strands were opened into filaments. Both were combined into a mat-like material.

Void ratios of the heat-moldable composite sheets and the composite molded articles obtained in Examples 1 to 17 and Comparative Examples 1 to 3 and the results (diameters and opening area ratios) of microscopic observation of fine holes on the surfaces of the composite molded articles are shown in Table 6.

TABLE 6

| Example | Void ratio of the heat-moldable composite sheet (%) | Void ratio of the composite molded article (%) | Microscopic observation of fine holes on the surface of the composite molded article [average value of 10 photos (50× magnification)] |
|---|---|---|---|
| 1 | 94 | 3 mm-thick portion: 82<br>8 mm-thick portion: 93 | Diameter of fine holes: 2–100 m (mostly 30–40 m) |
| 2 | 94 | 91 | (no film) |
| 3 | 91 | 88 | Diameter of fine holes: mostly 10–50 m (max. 300 m) Opening area ratio: 3.4% |
| 4 | 90 | 88 | Diameter of fine holes: mostly 10–50 m (max. 300 m) Opening area ratio: 2.8% |
| 5 | 95 | 90 | (no film) |
| 6 | 92 | 90 | Diameter of fine holes: mostly 10–50 m (max. 300 m) Opening area ratio: 5.6% |
| 7 | 92 | 88 | Diameter of fine holes: mostly 10–50 m |

TABLE 6-continued

| | | | |
|---|---|---|---|
| | | | (max. 300 m) Opening area ratio: 5.4% |
| 8 | 91 | 87 | Diameter of fine holes: mostly 10–50 m<br>(max. 300 m) Opening area ratio: 4.2% |
| 9 | 91 | 3 mm-thick portion: 73<br>8 mm-thick portion: 90 | Diameter of fine holes: 1–50 m<br>Opening area ratio: 12.0% |
| 10 | 94 | 3 mm-thick portion: 82<br>8 mm-thick portion: 93 | Diameter of fine holes: 1–50 m<br>Opening area ratio: 7.8% |
| 11 | 92 | 2.5 mm-thick portion: 75<br>5 mm-thick portion: 87 | Diameter of fine holes: 1–50 m<br>Opening area ratio: 18.2% |
| 12 | 92 | 2.5 mm-thick portion: 74<br>5 mm-thick portion: 87 | |
| 13 | 92 | 90 | laminated with a skin |
| 14 | 92 | 90 | (Fine holes are unclear.) |
| 15 | 94 | 3 mm-thick portion: 82<br>5 mm-thick portion: 93 | Diameter of fine holes: 1–50 m<br>Opening area ratio: 7.4% (front)<br>0.6% (back) |
| 16 | " | 3 mm-thick portion: 82<br>5 mm-thick portion: 93 | Diameter of fine holes: 1–50 m<br>Opening area ratio: 8.2% (front)<br>0.2% (back) |
| 17 | " | 3 mm-thick portion: 82<br>5 mm-thick portion: 93 | Diameter of fine holes: 1–50 m<br>Opening area ratio: 6.9% (front)<br>0.9% (back) |
| Comparative Example | Void ratio of the sheet (%) | Void ratio of the molded article (%) | |
| 1 | 75 | 69 | Diameter of fine holes: 10–50 m<br>Opening area ratio: 0.4% |
| 2 | 78 | 73 | Diameter of fine holes: 10–50 m<br>Opening area ratio: 0.6% |

What we claim is:

1. A process for producing a composite molded article which comprises forming a nonwoven fibrous mat composed of inorganic monofilaments having a length of 10 to 200 mm and a diameter of 2 to 30 micrometers and a thermoplastic resin binder, heating the mat at a temperature above the melting point of the thermoplastic resin binder, compressing the mat at said temperature, then releasing the compression to form a compression-released mat, recovering the thickness of the mat to obtain a heat-moldable composite sheet, and heat-molding the resulting composite sheet, wherein the step of recovering the thickness of the mat is carried out by pulling both sides of the compression-released mat outwardly at a temperature above the melting point of the binder.

2. The process of claim 1 wherein the thermoplastic resin is fibrous.

3. The process of claim 1 wherein the thermoplastic resin is powdery.

4. The process of claim 1 wherein the thermoplastic resin binder is a thermoplastic resin selected from the group consisting of polyethylene, polypropylene, saturated polyesters, polyamides and mixtures thereof.

5. The process of claim 1 wherein inorganic monofilaments are glass fibers.

6. The process of claim 1 wherein a weight ratio of the inorganic monofilaments to the thermoplastic resin binder is 1:5 to 5:1.

7. The process of claim 2 wherein the fibrous thermoplastic resin has a length of 5 to 200 mm and a diameter of 3 to 50 micrometers.

8. The process of claim 1 wherein the nonwoven fibrous mat is formed by feeding inorganic fiber strands and the thermoplastic resin binder to a carding machine where the strands are opened into filaments, and combining both the filaments and the binder.

9. The process of claim 1 including a step of needle-punching the mat.

10. The process of claim 1 wherein the heating temperature of the mat is 10° to 70° C. higher than the melting point of the binder, and the heating time is 1 to 10 minutes.

11. The process of claim 1 wherein the mat is compressed with a press at a pressure of 0.1 to 10 kg/cm$^2$.

12. The process of claim 1 wherein the mat is compressed via rolls with a clearance between rolls being 1/5 to 1/20 of the thickness of the mat prior to compression.

13. The process of claim 1 wherein the step of pulling both sides of the mat outwardly is carried out by laminating sheets made of materials which are melt-adhered to the binder in a molten state but not to the binder in a non-molten state on both sides of the mat before compression thereof, and sucking the sheets in vacuo outwardly in a molten state of the binder after releasing the compression.

14. The process of claim 13 wherein the sheets are selected from the group consisting of glass fiber reinforced polytetrafluoroethylene sheets, sheets whose surface is treated with polytetrafluoroethylene and polyester sheets whose surface is subjected to mold release treatment.

15. A process for producing a composite sheet which comprises forming a nonwoven fibrous mat from inorganic monofilaments having a length of 10 to 200 mm and a diameter of 2 to 30 micrometers and a thermoplastic resin binder, laminating at least one thermoplastic resin film on at least one side of the nonwoven fibrous mat to form a laminated sheet, heating the laminated sheet at a temperature above the melting point of at least one of the thermoplastic resin films, compressing the laminated sheet at said temperature, then releasing the compression to form a compression-released laminated sheet, recovering the thickness of the laminated sheet to obtain a heat-moldable composite sheet, and heat-molding the resulting composite sheet, wherein the step of recovering the thickness of the laminated sheet is carried out by pulling both sides of the compression-released laminated sheet outwardly at a temperature above the melting point of the binder.

16. The process of claim 15 wherein the step of pulling both sides of the laminated sheet outwardly is carried out by laminating sheets made of materials which are melt-adhered to the binder in a molten-state but not to the binder in a non-molten state on both sides of the laminated sheet before compression thereof, and sucking the sheets in vacuo outwardly in a molten state of the binder after releasing the compression.

17. The process of claim 16 wherein each of the sheets is selected from the group consisting of glass fiber reinforced polytetrafluoroethylene sheets, sheets whose surface is treated with polytetrafluoroethylene and polyester sheets whose surface is subjected to mold release treatment.

18. The process of claim 15 wherein the inorganic filaments of the nonwoven fibrous mat have a thermoplastic resin deposited thereon prior to the laminating of the film.

19. The process of claim 18 wherein the thermoplastic resin is fibrous.

20. The process of claim 18 wherein the thermoplastic resin in powdery.

21. The process of claim 15 wherein the thermoplastic resin film is selected from the group consisting of polyethylene, polypropylene, polystyrene, saturated polyesters, polyamides and mixtures thereof.

22. A process for producing a composite sheet which comprises forming a nonwoven fibrous mat from inorganic monofilaments having a length of 10 to 200 mm and a diameter of 2 to 30 micrometers, laminating at least one thermoplastic resin film on at least one side of the nonwoven fibrous mat to form a laminated sheet, heating the laminated sheet at a temperature above the melting point of at least one of the thermoplastic resin films, compressing the laminated sheet at said temperature, then releasing the compression, recovering the thickness of the laminated sheet to obtain a heat-moldable composite sheet, and heat-molding the resulting composite sheet, wherein thermoplastic resin films whose melting points are approximately the same but whose melt indices are different from each other are laminated on both sides of the nonwoven fibrous mat, the melt index of one of the thermoplastic resin films is 2 to 40 g/10 min, and the melt index of the other is 1 to 7 g/10 min.

23. The process of claim 22 wherein the inorganic filaments of the nonwoven fibrous mat have a thermoplastic resin deposited thereon prior to the laminating of the film.

24. The process of claim 23 wherein the thermoplastic resin is fibrous.

25. The process of claim 23 wherein the thermoplastic resin is powdery.

26. The process of claim 22 wherein the thermoplastic resin film is selected from the group consisting of polyethylene, polypropylene, polystyrene, saturated polyesters, polyamides and mixtures thereof.

27. The process for producing the composite sheet which comprises forming a nonwoven fibrous mat from inorganic monofilaments having a length of 10 to 200 mm and a diameter of 2 to 30 micrometers, laminating at least one thermoplastic resin film on at least one side of the nonwoven fibrous mat to form a laminated sheet, heating the laminated sheet at a temperature above the melting point of at least one of the thermoplastic resin films, compressing the laminated sheet at said temperature, then releasing the compression, recovering the thickness of the laminated sheet to obtain a heat-moldable composite sheet, and heat-molding the resulting composite sheet, wherein two or more layers of thermoplastic resin films different in melt index are laminated on one side of the nonwoven fibrous mat such that their melt indices are increased sequentially from the outer layer to the inner layer.

28. The process of claim 27 wherein the inorganic filaments of the nonwoven fibrous mat have a thermoplastic resin deposited thereon prior to the laminating of the film.

29. The process of claim 28 wherein the thermoplastic resin is fibrous.

30. The process of claim 28 wherein the thermoplastic resin is powdery.

31. The process of claim 27 wherein the thermoplastic resin film is selected from the group consisting of polyethylene, polypropylene, polystyrene, saturated polyesters, polyamides and mixtures thereof.

* * * * *